United States Patent [19]

Kitashima et al.

[11] 4,311,030

[45] Jan. 19, 1982

[54] METHOD AND APPARATUS FOR CONTROLLING TEMPER-ROLLED PROFILE OF COLD ROLLED STEEL STRIP AFTER CONTINUOUS ANNEALING

[75] Inventors: Satoyuki Kitashima; Norichika Nagira, both of Kitakyusyu, Japan

[73] Assignee: Nippon Steel Corporation, Tokyo, Japan

[21] Appl. No.: 102,346

[22] Filed: Dec. 11, 1979

[30] Foreign Application Priority Data

Dec. 14, 1978 [JP] Japan ..... 53-153626

[51] Int. Cl.[3] ..... B21B 37/00; B21B 1/28; B21B 31/18

[52] U.S. Cl. ..... 72/8; 72/10; 72/205; 72/247; 148/12 R; 266/102

[58] Field of Search ..... 72/8, 9, 10, 11, 12, 72/17, 247, 205, 16; 148/12 B, 12 R, 131, 156; 266/102

[56] References Cited

U.S. PATENT DOCUMENTS

| | | | |
|---|---|---|---|
| 2,585,277 | 2/1952 | Seabold | 266/102 X |
| 2,906,652 | 9/1959 | Kiefer, Jr. | 148/12 R |
| 3,584,853 | 6/1971 | Munson | 72/17 X |
| 3,618,348 | 11/1971 | Arimura et al. | 72/7 |
| 3,818,743 | 6/1974 | Kajiwara | 72/243 |

*Primary Examiner*—Milton S. Mehr

*Attorney, Agent, or Firm*—Cushman, Darby & Cushman

[57] ABSTRACT

A method and apparatus for controlling a temper-rolled profile of a cold rolled steel strip after continuous annealing, comprising subjecting the continuously annealed cold rolled steel strip simultaneously to temper-rolling and profile controlling by use of a six-high rolling mill of intermediate roll shifting type in the same production line.

5 Claims, 7 Drawing Figures

METHOD AND APPARATUS FOR CONTROLLING TEMPER-ROLLED PROFILE OF COLD ROLLED STEEL STRIP AFTER CONTINUOUS ANNEALING

BACKGROUND OF THE INVENTION

1. Field of the Invention

The present invention relates to a method and apparatus for controlling the temper-rolled profile of a cold rolled steel strip after continuous annealing.

In recent years, more and more of cold rolled steel sheets and strips are produced through a continuous production line in which a continuous annealing furnace, a temper-rolling mill and a refining section. It is a general requirement for cold rolled steel sheets and strips that they should have a good profile with excellent flatness in particular, but in event a cold rolled steel strip produced through the continuous production line should have an unsatisfactory profile, it is very difficult to perform a re-rolling for correcting the unsatisfactory profile. Therefore, for production of steel sheets which are required to meet with a severe requirement of flatness, high-tension steel sheets and steel sheets which are required to be subjected to a large reduction by temper-rolling (hereinafter called "high temper reduction materials" normally they are subjected to 5% or higher reduction by temper-rolling), a four-high temper-rolling mill followed by a leveller for correcting the profile is conventionally provided after the continuous annealing furnace in the continuous production line.

Therefore, the conventional art has problems that the whole length of the continuous production line must be considerably increased and the capital cost is inevitably increased, and that a steel sheet which is levelled by a tension leveller in addition to the temper-rolling has defects that the ageing phenomenon appears prematurely and deterioration of the mechanical properties due to the ageing is remarkable and thus the workability of the resultant cold rolled strip or sheet is poor.

Moreover, various grades and sizes of steel sheets and strips are produced by the continuous production line.

For increasing the production rate, strips of different sizes and compositions are welded together between the finishing end of a preceding strip and the starting end of a subsequent strip (welded point), so that they are continuously passed through the rolling mill.

Therefore, when the temper-rolling is performed by a four-high temper-rolling mill, such disadvantages are induced that the rolls must be replaced more frequently and a more number of rolls must be preserved for the replacement, because the rolls must be replaced with ones having a proper roll curve in accordance with the sizes, compositions, rolling reduction rates of the steel sheets and strips to be rolled.

Further, when a four-high temper-rolling mill is used for the temper-rolling, there is brought about such problems that the rolled profile of steel sheets and strips is severely destroyed if the change in the sheet width is large at the time of passage of the welding point, and rolling problems such as wrinkling are easily caused so that the strip walk in the width direction is considerably limited at the time of the size-change operation, thus hindering a proper adjustment of the pass schedule.

2. Summary of the Invention

Therefore, one of the objects of the present invention is to provide a method and apparatus for temper-rolling suitable for use in the continuous production line, without the disadvantages and defects as hereinbefore mentioned.

The aforementioned object of the present invention is achieved by performing the temper-rolling simultaneously with the profile controlling with use of a six-high rolling mill stand of intermediate roll shifting type.

The present invention may be summarized as below:

(1) A method for controlling a temper-rolled profile of a cold rolled steel strip after continuous annealing, comprising subjecting the continuously annealed cold rolled steel strip simultaneously to temper-rolling and profile controlling by use of a six-high rolling mill of intermediate roll shifting type in the same production line.

(2) A continuous annealing apparatus comprising: a continuous annealing furnace, a temper-rolling section and a refining section, said temper-rolling section being provided with a six-high temper-rolling mill of intermediate roll shifting type, composed of the upper three rolls and the lower three rolls, and the intermediate rolls in the upper and lower three rolls are designed to be shiftable in the axial direction, and being omitted of a profile controlling device.

BRIEF EXPLANATION OF THE DRAWINGS

FIG. 1(*b*) shows a front view of the same mill stand shown in FIG. 1(*a*).

DETAILED DESCRIPTION OF THE INVENTION

Descriptions will be made on the six-high rolling mill of intermediate roll shifting type used in the present invention referring to FIG. 1.

Figure 1:
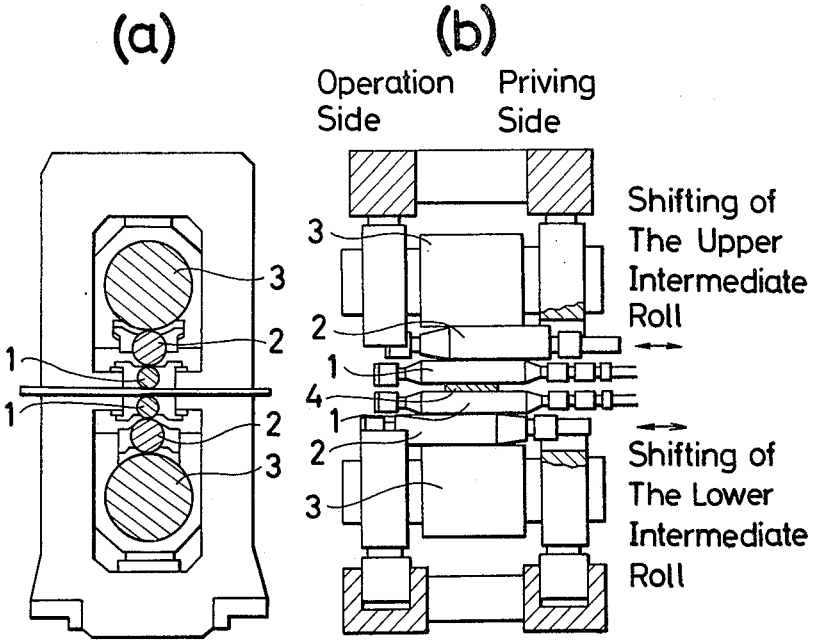
FIG. 1(*a*) shows a side view of the six-high temper-rolling mill stand used in the present invention.

In FIG. 1, 1 is a work roll, 2 is an intermediate roll and 3 is a back-up roll. The intermediate rolls 2 are designed to be shiftable in the axial direction so as to adjust the load distribution on the work rolls 3 for each lot of steel strips of be temper-rolled. 4 is a steel strip. The six-high rolling mill stand has the following advantages.

Figure 2:
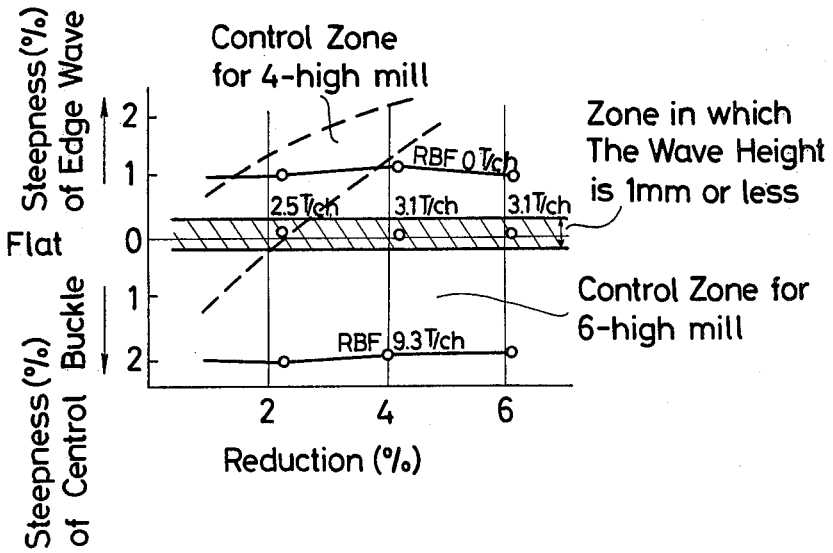
FIG. 2 is a graph showing the relation between the reduction rate and the profile characteristics the steepness(%) of the central buckle and the steepness(%) of the edge wave.

(1) Excellent profile controlling can be achieved. As clearly understood from FIG. 2 showing the relation between the reduction rate and the profile characteristics the steepness (%) of the central buckle and the steepness (%) of the edge wave (%), even in the high reduction zone (4–6%), a good profile can be obtained by a low roll bending force if the position of the intermediate rolls is properly adjusted.

(2) The work roll may have only one roll curve pattern (flat), and even when the strip width changes a satisfactory operational condition can be provided while maintaining a good profile of the strip by changing the position of one or both of the upper and lower intermediate rolls.

When the six-high rolling mill stand is arranged in the rear of a continuous annealing furnace according to the present invention the following considerations must be made.

In the case of a six-high rolling mill stand, the rolling force distribution sharply changes in the shoulder portions of the intermediate rolls, so that when the steel strip is rolled with the intermediate rolls being positioned within the width of the steel strip (namely, the composite width formed by the upper and lower intermediate rolls is equal or less than the strip width being rolled), irregularities take place on the product surface. Also when the position of the edges of intermediate rolls is near the position of the strip width, the strip profile has much tendency of changing.

Therefore, according to the present invention, the position of one or both the upper and lower intermediate rolls is adjusted in the axial direction so as to assure that the composite width formed by the upper and lower intermediate rolls is equal or larger than the width of the strip being rolled.

Therefore, steel strips of different widths are continuously rolled, it is necessary to detect the width change passing point and to control the position of the intermediate rolls in accordance with the strip width.

Figure 3:
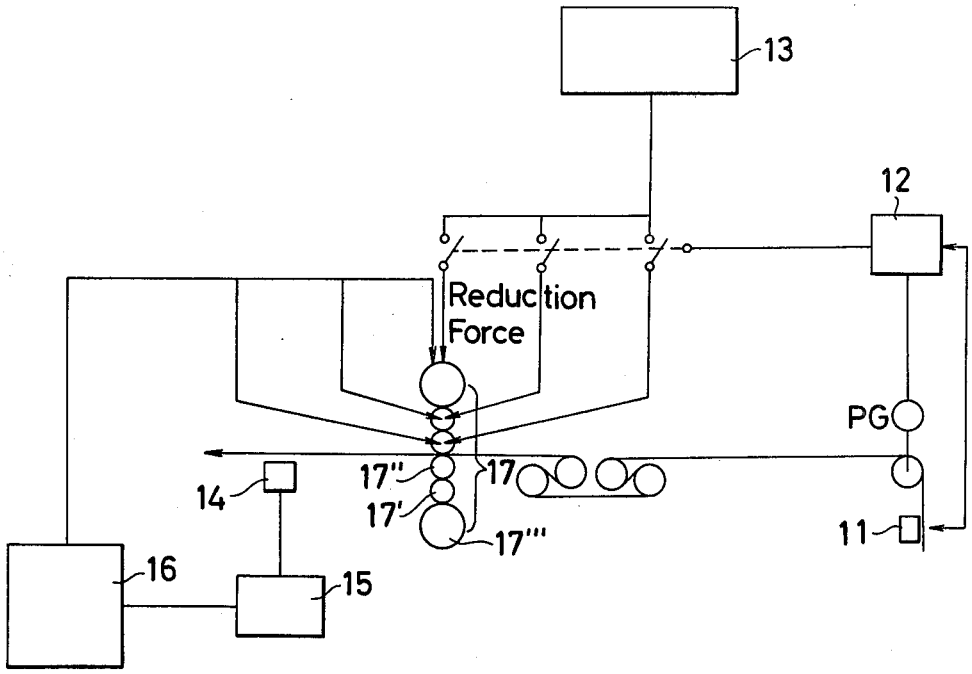
FIG. 3 schematically illustrates controlling of the position of the intermediate rolls.

The controlling method of the position of the intermediate rolls will be described by referring to FIG. 3.

When the temper-rolling conditions, such as the grades and sizes of cold rolled steel strips, and the required rolling reduction rates, change, the welding point is detected by a welding point detector 11 arranged in advance of the six-high temper-rolling mill stand and the timing for changing the rolling conditions such as changing of the position of the intermediate rolls and setting of the rolling forces is predetermined by a welding point positioning operator 12, and a predetermined time after passing the welding point, the position of the intermediate rolls, the roll bending force and the reduction position, preset by a preset computor 13 are set to predetermined values so as to prevent irregularities in the profile.

After the welding point passes through the mill stand, the actual profile of the steel strip is detected by a profile detector 14 provided in the rear side of the six-high temper-rolling mill stand so as to identify the profile by a profile identifier 15, and the position of the intermediate rolls, the roll bending force and the reduction position are computed by a control amount operator 16, so as to control the position of the intermediate roll 17' in the six-high rolling mill stand 17.

One embodiment of the temper-rolling section according to the present invention will be described by referring to FIG. 4.

Figure 4:
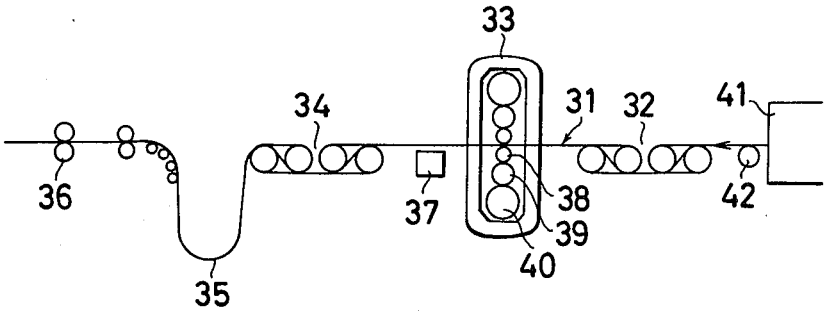
FIG. 4 shows one embodiment of the temper-rolling section according to the present invention.

In FIG. 4, 31 is a steel strip, 32 is a bridle roll, 33 is a six-high rolling mill stand, 34 is a bridle roll, 35 is a free loop, 36 is a side-trimmer, 37 is a profile detector, 38 is a work roll, 39 is an intermediate roll, and 40 is a back-up roll. A steering roll 42 is arranged on the inlet side of the six-high rolling mill stand so as to perform centering of a steel strip coming from a continuous annealing furnace 41 or to detect the strip walk amount, and when the unsymmetric component on the driving and operation sides corresponding to the detected walk amount is added to the set value of the intermediate roll position, the present invention can be more advantageously performed.

The following advantages can be achieved by the present invention.

(1) The high-reduction material can be passed stably.

(1)-1: According to a conventional rolling mill stand, the work roll and the back-up roll are subjected to bending due to the high reduction rolling operation, and particularly on the both ends in the width direction the bending of the work roll is remarkable due to the reverse bending force by the back-up roll, resulting in edge wavings. Therefore, as the work roll is provided with a convex roll curve, the central buckle is caused in the central crown portion of the strip and also edge wavings are caused in the edge portions of the strip due to the reverse bending force of the back-up roll. Therefore, it is necessary to change or replace the rolls having different roll curves for each lot of the high-reduction materials and ordinary materials.

Contrary to the above, when the six-high rolling mill stand according to the present invention is used, the welding point is detected by the welding point detector 11, and when the welding point passes the six-high rolling mill, the position in the axial direction of the intermediate roll and the rolling force are changed in correspondence to the change of the strip width, and at the same time the roll load distribution due to the high-reduction is adjusted by positioning of the intermediate rolls in the axial direction so that the work rolls can be bent in correspondence to the crown of the steel strip by a single roll curve pattern. Also the both edges of the steel strip are free from the influence by the reverse bending force of the reinforcing roll, and the edge portions of the work roll are free so that an excellent strip profile can be obtained by a single roll curve even in the case of a high temper-rolling reduction, because an increased-discreased bender (increase and decrease of the bending given to the work rolls) works effectively.

(1)-2: According to a conventional rolling mill, the edge portions of the steel strip are subjected to sharp edge drops due to the roll bending and irregular flattening by the high rolling reduction, and thus it is necessary to trim the steep strip in the subsequent refining section.

Contrary to the above, when the six-high rolling mill stand according to the present invention is used, the edge portion of the work roll is not bent, and a work roll of relatively small diameter as compared with those used in a conventional rolling mill can be used so that the rolling load can be reduced and the irregular flattening of the roll can be effectively prevented, thus considerably reducing the edge drop of the edge portions of the steel strip.

Figure 5:
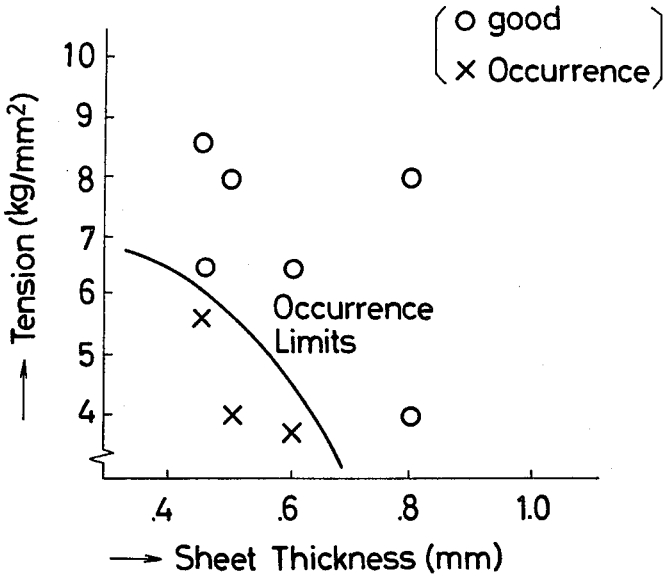
FIG. 5 is a graph showing occurrence of cross-buckles in ordinary steels.
Figure 6:
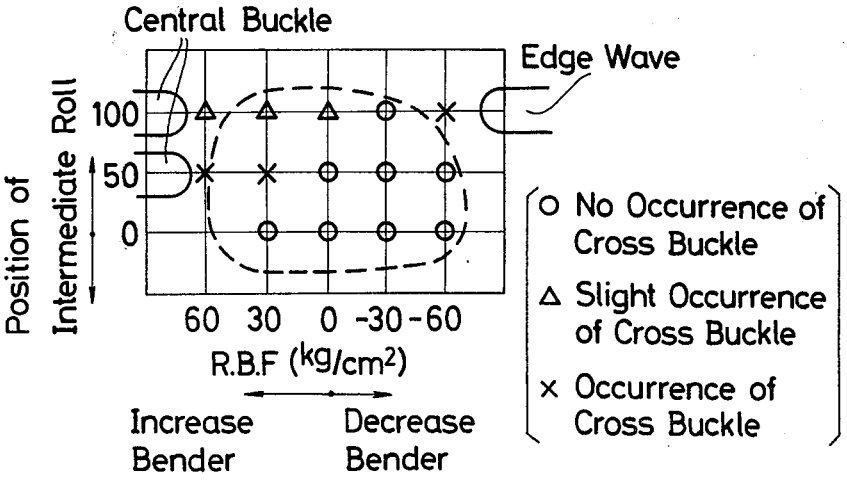
FIG. 6 is a graph showing the zone in which the cross-buckles occur depending on the position of the intermediate rolls in combination with a bender.

(1)-3: When a high-tension steel strip is temper-rolled by a conventional rolling mill stand, the central buckle and edge waving are readily caused, and unbalance is caused in their internal strain distributions in the strip, thus causing cross-buckles. In the case of an ordinary steel strip, the cross-buckles can be solved by the mill tension as understood from the occurrence of cross-buckles shown in FIG. 5, but they cannot be solved in the case of a high-tension steel.

Contrary to the above, when the six-high temper-rolling mill according to the present invention is used, a rolled profile free from the cross-buckle (irregular flat profile) can be obtained easily for a wide range of materials so that it is not necessary to give tensions to the strip in the subsequent step and thus the quality of the strip is not changed.

(2) A steel strip of excellent profile can be obtained.

(2)-1: No profile correcting device is required any more in the present invention. When the six-high rolling mill is used, a wider range of profile can be controlled as compared by a conventional rolling mill, and the centering of the strips 31 is effected by the steering roll 42, and the position of the intermediate rolls and the rolling force are changed when the welding point of the strip passes through the mill stand by detection of the welding point so as to avoid excessive load so that a good strip profile can be obtained by the rolling mill stand alone, thus eliminating necessity of providing a profile correcting device in subsequence to the rolling mill stand.

(2)-2: By the elimination of a profile correcting device, the following advantages can be obtained.

(a) In the case where no tension leveller is used, the material deterioration (lowered elongation and increased yield point) due to the tension given to the strip can be prevented because no tension is given.

(b) In the case where no leveller is used, quality deteriorations, such as leveller marks, can be prevented.

PREFERRED EMBODIMENTS OF THE INVENTION

The present invention will be better understood from the following description of preferred embodiments in comparison with the conventional methods.

EXAMPLE 1

In this example, the strip 31 is a high strength cold rolled steel strip having composition; C : 0.09% Si: 0.9%, Mn: 1.0%, P: 0.02%, S: 0.10% with the balance being Fe.

(1) Comparison of the present invention with the conventional method A (continuous annealing furnace+four-high rolling mill) and the conventional method B (continuous annealing furnace+four-high rolling mill+leveller) in respect to the strip profile as obtained.

TABLE 1

| | Material | Annealing Condition | Temper Rolling Reduction | Profile Quality Wave Heigt Edge Wave | Steepness |
|---|---|---|---|---|---|
| Present Invention | High Strength Cold Rolled Steel Strip | 700° C. × 1 min. | 1–1.5% | 1–3mm | 0–0.5% |
| Conventional Method A | High Strength Cold Rolled Steel strip | 700° C. × 1 min. | " | 8–12mm | 2–3% |
| Conventional Method B | High Strength Cold Rolled Steel Strip | 700° C. × 1 min. | " | 4–7mm | 1–1.5% |

As clearly understood from Table 1, the profile is stabilized only when a leveller is provided in the conventional methods, while the best profile can be obtained without a leveller in the present invention.

(2) Comparison in respect of the quality deterioration.

TABLE 2

| | Material | Annealing Condition | Temper-Rolling Reduction | Mechanical Tests YP kg/mm² | TS kg/mm² | El % |
|---|---|---|---|---|---|---|
| Present Invention | High Strength Cold Rolled Steel Strip | 700° C. × min. | 1–1.5% | 31–33 | 52–55 | 27–30 |
| Conventional Method A | High Strength Cold Rolled Steel Strip | 700° C. × 1 min. | 1–5% | 32–34 | 54–55 | 26–29 |
| Conventional Method B | High Strength Cold Rolled Steel Strip | 700° C. × 1 min. | 1–1.5% +leveller 0.6% | 34–35 | 55–56 | 25–27 |

EXAMPLE 2

In this example, a high temper-rolling reduction is applied so as to obtain high-reduction materials having a composition; C: 0.03%, Si: 0.15%, Mn: 0.42%, P: 0.130%, S: 0.011% with the balance being Fe.

The profile quality and the mechanical properties obtained with 5% temper-rolling reduction are respectively shown in Table 3 and Table 4 in comparison with the conventional method A (same as in Example 1) and the conventional method B (same as in Example 1).

TABLE 3

| | Material | Annealing Condition | Temper-Rolling Reduction | Profile Quality Wave Height mm | Steepness % |
|---|---|---|---|---|---|
| Present Invention | A | 700° C. × 1 min. | 5% | 1–4 | 0.2–1.0 |
| Conventional Method A | " | 700° C. × 1 min. | " | 5–9 | 1.3–3.8 |
| Conventional | " | 700° C. × 1 min. | " | 3–7 | 0.8–1.5 |

TABLE 3-continued

| | Material | Annealing Condition | Temper-Rolling Reduction | Profile Quality Wave Height mm | Profile Quality Steepness % |
|---|---|---|---|---|---|
| Method B | | | | | |

TABLE 4

| | Material | Annealing Condition | Temper-Rolling Reduction | Mechanical Tests YP (kg/mm²) | TS (kg/mm²) | El (%) | YP/TS |
|---|---|---|---|---|---|---|---|
| Present Invention | A | 700° C. × 1 min. | 5% | 41.0 | 50.2 | 21.2 | 0.817 |
| Conventional Method A | " | 700° C. × 1 min. | " | 41.3 | 50.4 | 20.7 | 0.819 |
| Conventional Method B | " | 700° C. × 1 min. | " | 43.1 | 50.8 | 19.4 | 0.848 |

As clearly understood from Tables 3 and 4, an excellent profile quality can be obtained even when a high temper-rolling reduction is applied in the present invention, and the resultant mechanical property is also quite excellent with excellent workability.

It is very difficult to obtain a steel sheet with a good profile without quality deterioration by the conventional four-high rolling mill stand, while the present invention has made it possible to obtain a steel sheet with a very good profile without using a leveller as shown in Table 1 through Table 4. Therefore, the present invention provides great industrial profits and advantages.

What is claimed is:

1. A method for controlling a temper-rolled profile of a cold rolled steel strip after continuous annealing, comprising subjecting the continuously annealed cold rolled steel strip simultaneously to temper-rolling and profile controlling by use of a six-high rolling mill of intermediate roll shifting type in the same production line.

2. A method according to claim 1, in which the position of an intermediate roll of the six-high rolling mill is controlled in accordance with the width of the strip.

3. A method according to claim 1, in which the position of an intermediate roll of the six-high rolling mill and the rolling force of the mill are changed when a welding point of the strip passes the mill.

4. An apparatus for controlling a temper-rolled profile of a cold rolled steel strip after continuous annealing comprising a temper-rolling section, and a refining section, said temper-rolling section being provided with a six-high temper-rolling mill stand equipped with an axially shiftable intermediate roll.

5. An apparatus according to claim 4, which further comprises a detector for detecting a welding point of the strip; a welding point position computor for predetermining the timing for changing the position of the intermediate roll and the rolling force; a preset computor for presetting the position, the roll bending force and the rolling position of the intermediate roll; a profile detector 14 for detecting the actual profile of the strip rolled by the mill stand; a profile identifier for identifying the actual profile of the strip; and a control amount computor 16 for computing the position, roll bending force and rolling position of the intermediate roll.

* * * * *